US005600086A

United States Patent [19]

Lemonnier

[11] Patent Number: 5,600,086

[45] Date of Patent: Feb. 4, 1997

[54] TARGET DETECTION DEVICE USING A TRIGGER WIRE

[75] Inventor: Georges Lemonnier, Arcay, France

[73] Assignee: Giat Industries, Versailles, France

[21] Appl. No.: 367,156

[22] PCT Filed: Jul. 13, 1994

[86] PCT No.: PCT/FR94/00883

§ 371 Date: Jan. 10, 1995

§ 102(e) Date: Jan. 10, 1995

[87] PCT Pub. No.: WO95/03522

PCT Pub. Date: Feb. 2, 1995

[30] Foreign Application Priority Data

Jul. 22, 1993 [FR] France ..... 93 09002

[51] Int. Cl.[6] ..... F42B 23/10

[52] U.S. Cl. ..... 102/424; 102/401

[58] Field of Search ..... 102/401, 421–424, 102/427–429

[56] References Cited

U.S. PATENT DOCUMENTS

| | | | |
|---|---|---|---|
| H1178 | 5/1993 | Zacharin | 102/210 |
| 2,330,205 | 9/1943 | Cox | 89/1 |
| 3,376,815 | 4/1968 | Pelszynski | 102/424 |
| 3,641,938 | 2/1972 | Gawlick et al. | 102/207 |
| 3,754,508 | 8/1973 | Dalton | 102/215 |
| 3,831,521 | 8/1974 | Engeli | 102/404 |
| 3,844,215 | 10/1974 | Rogers, Jr. et al. | 102/8 |
| 3,921,530 | 11/1975 | Burkhardt | 102/70.2 R |
| 3,964,392 | 6/1976 | Kintish et al. | 102/404 |
| 4,402,271 | 9/1983 | Heidmann et al. | 102/362 |
| 4,920,884 | 5/1990 | Haglund et al. | 102/215 |
| 5,113,766 | 5/1992 | Grosch | 102/427 |
| 5,198,614 | 3/1993 | de la Haye et al. | 102/401 |
| 5,207,579 | 5/1993 | Campagnuolo | 434/11 |
| 5,345,874 | 9/1994 | Lemonnier et al. | 102/424 |

FOREIGN PATENT DOCUMENTS

| | | | |
|---|---|---|---|
| 518711 | 12/1992 | European Pat. Off. . | |
| 815386 | 7/1937 | France | 102/424 |
| 2406180 | 5/1979 | France . | |
| 2472900 | 7/1981 | France . | |
| 2640371 | 6/1990 | France . | |
| 2677750 | 12/1992 | France . | |
| 3713424 | 8/1988 | Germany | 102/427 |
| 4025680 | 10/1991 | Germany . | |
| 693810 | 7/1953 | United Kingdom | 102/401 |

*Primary Examiner*—Michael J. Carone
*Assistant Examiner*—Christopher K. Montgomery
*Attorney, Agent, or Firm*—Oliff & Berridge

[57] ABSTRACT

A device for detecting a target and for detonating an explosive device includes a displaceable trigger wire attached to a movable or deformable trigger member, and a detection device for detecting movement or deformation of the trigger member. In the case of a movable trigger member, movement of the trigger wire causes movement of the trigger member, and the detection device generates a detonation signal in response to the movement to cause detonation of the explosive. In the case of a deformable trigger member, movement of the trigger wire causes deformation of the trigger member, and the detection device generates a detonation signal in response to the deformation that causes the explosive device to detonate. The detection device may be located in the explosive device, with the trigger wire extending out away from the explosive device. Alternately, the detection device may be located in a support member located apart from the explosive device.

12 Claims, 5 Drawing Sheets

TARGET DETECTION DEVICE USING A TRIGGER WIRE

BACKGROUND OF THE INVENTION

The field of the present invention is that of devices for detecting a target by means of a trigger wire.

Such devices may be used in combination with a mine of the antipersonnel or anti-vehicle type.

Trigger wires are known which are placed on the ground by hand when the mine is laid.

These wires must be attached to a point remote from the mine so that they are in tension. Pulling or breaking the wire causes a firing pin to be released which detonates the explosive in the mine.

Patent FR2406180 describes such a device, Its principal disadvantage lies in requiring the trigger wires to be laid by hand, which prevents its dispersal by a shell, rocket or a launch system mounted on a vehicle.

Moreover the detonation device used with the wire is a complex and expensive mechanical system and cannot discriminate between different types of targets.

Trigger wires are also known which consist of flexible conductors designed to be broken by the target.

The break is detected by the electronics in the mine from the resulting change in electrical resistance of the wires.

The principal disadvantage of these wires is that they are fragile. Automatic deployment of the wires by pyrotechnic means (for example using the means described in patent FR2677750) is liable to break them, thus rendering the mine totally ineffective.

Finally trigger wires are known which consist of an optical fiber. Crushing of the said fiber modifies the light signal transmitted by the fiber and detonates the mine.

This approach is expensive. Moreover it involves substantial energy consumption because light muse be continuously transmitted through the fiber.

To limit this power consumption it is necessary to have recourse to a passive monitoring system (for example acoustic) which further complicates the detonation system of the mine.

This kind of trigger wire is usually reserved for antitank mines.

SUMMARY OF THE INVENTION

The purpose of the invention is to propose a trigger wire detection device which does not have such drawbacks.

The purpose of the invention is therefore to propose a robust and inexpensive trigger device which can be deployed automatically by the mine itself.

This device, nevertheless, has excellent reliability and permits target recognition.

The subject of the invention is a device for detecting a target, and for initiating the detonation of a mine. The device comprises a trigger wire intended to be displaced by the target, and means of processing a signal provided by the displacement of the trigger wire. The processing means may include a component attached to the trigger wire and capable of being moved longitudinally and/or of being deformed with respect to a fixed support when the trigger wire is displaced, and means of detecting the displacement and/or the deformation of the component with respect to the support. According to a first embodiment, the component attached to the trigger wire comprises a permanent magnet and the means of detecting the displacement of this component comprises a contactor with at least two magnetic reeds, the contactor being attached to the support and placed in the vicinity of the magnet.

The support may then be attached to the mine. According to a second embodiment, the component attached to the trigger wire comprises a contactor having at least two magnetic reeds, and the means of detecting the displacement of this component comprises at least one permanent magnet attached to the support and placed in the vicinity of the contactor.

The support may take the form of a cylindrical casing, the contactor being attached to a bushing which is slidably mounted inside the casing and the magnet will comprise a central cavity which the contactor is able to penetrate when the trigger wire is displaced. The contactor may be attached to the bushing by means of a resin.

According to a third embodiment, the component attached to the trigger wire is a small plate. One end of the plate is attached to the support, and the plate includes a strain gauge. The means of detecting the deformation of this component comprises an electronic circuit used for measuring the forces exerted on the gauge when the trigger wire is displaced.

If the device is fitted to a mine, the support may consist of a weight which is ejected or positioned at some distance from the mine.

The device may comprise a compression spring positioned between the component attached to the trigger wire and the support.

The device may also comprise damping means arranged between the component attached to the trigger wire and the support.

These damping means will preferably comprise a spring of a "shape recall" material. According to another embodiment of the invention, the component attached to the trigger wire comprises a deformable membrane with at least one conducting surface. The means of detecting the displacement comprise an electrical circuit attached to the support, and including at least one part on which the membrane normally rests so as to close the circuit by means of its conducting surface and from which it is separated during its deformation, thus opening the electrical circuit.

According to a basic feature of this embodiment, the deformable membrane has a central part to which the trigger wire is attached and a peripheral part attached to the support, the central and peripheral parts being separated by at least one zone of reduced thickness permitting deformation.

The membrane will preferably be made from an electrically conducting material.

The electrical circuit may be constructed on a plate using the technique of printed circuits.

In a variant, the support may consist of a weight which is ejected by or placed at a distance from the mine, and the trigger wire may comprise a pair of conductors which pass through the membrane and whose ends are soldered on the electrical circuit.

The trigger wire may be attached to the membrane by a moulding or by glueing.

BRIEF DESCRIPTION OF THE DRAWING

The invention will be better understood from the following description of particular embodiments with reference to the attached drawings on which.

DETAILED DESCRIPTION OF PREFERRED EMBODIMENTS

Figure 1:
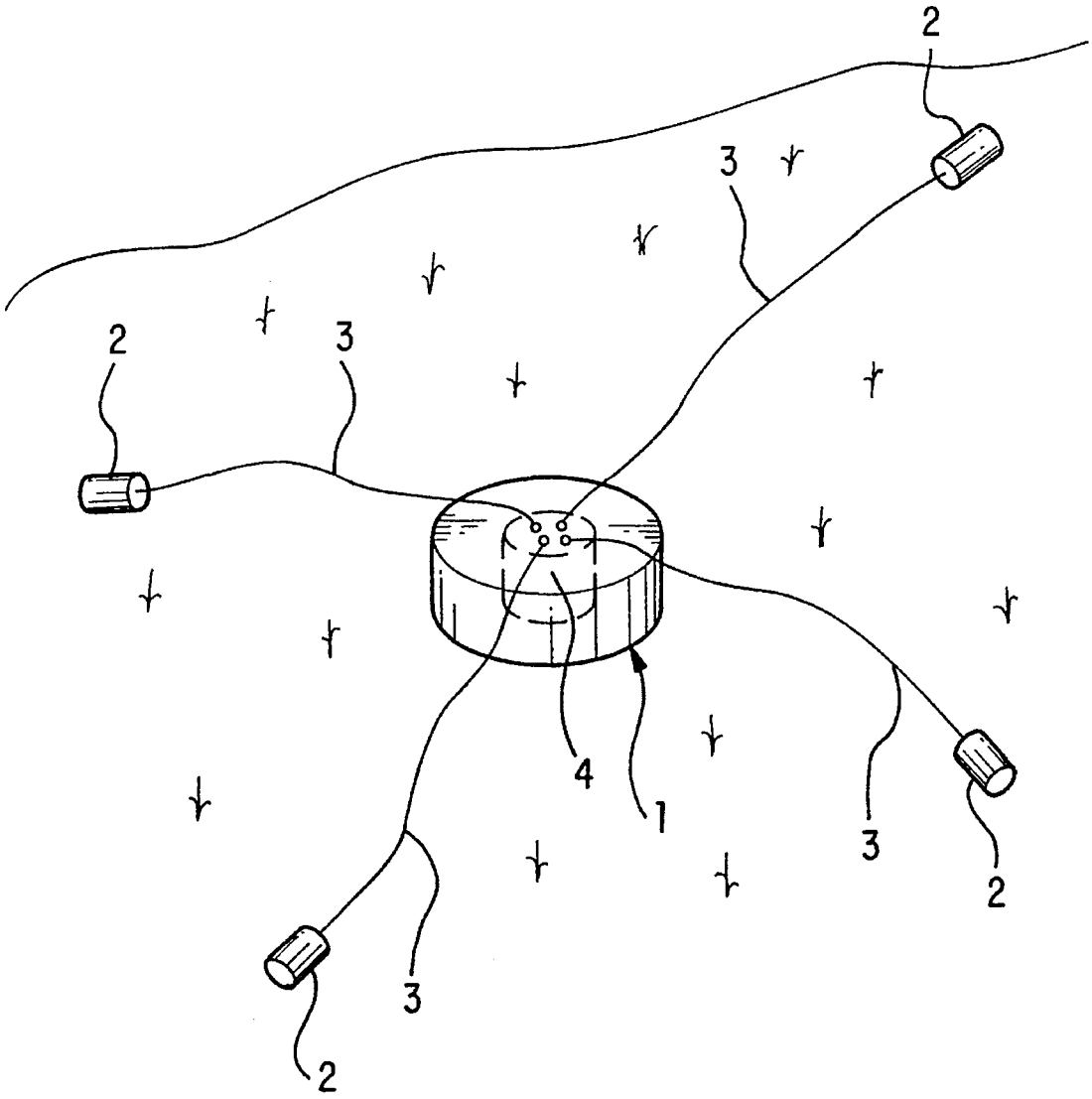
FIG. 1 is a schematic illustration of an antipersonnel mine placed on the ground and comprising four trigger wires according to the invention.

With reference to FIG. 1, a mine 1 of the antipersonnel type is placed on the ground by a means of scattering device (not shown), such as a shell, rocket or launch system mounted on a vehicle). After coming to rest on the ground, and after a programmed time interval, this mine ejects four weights 2. Each weight unwinds behind it a trigger wire 3 which remains attached to the mine.

The trigger wires 3 are connected to processing electronics 4 located in the mine 1.

A mine fitted with a device for the deployment of trigger wires is described in patent FR2677750, and the means of deployment will therefore not be described in detail herein.

Any displacement of the trigger wires 3 is noted by a detection device which initiates detonation of the mine.

Figure 2:
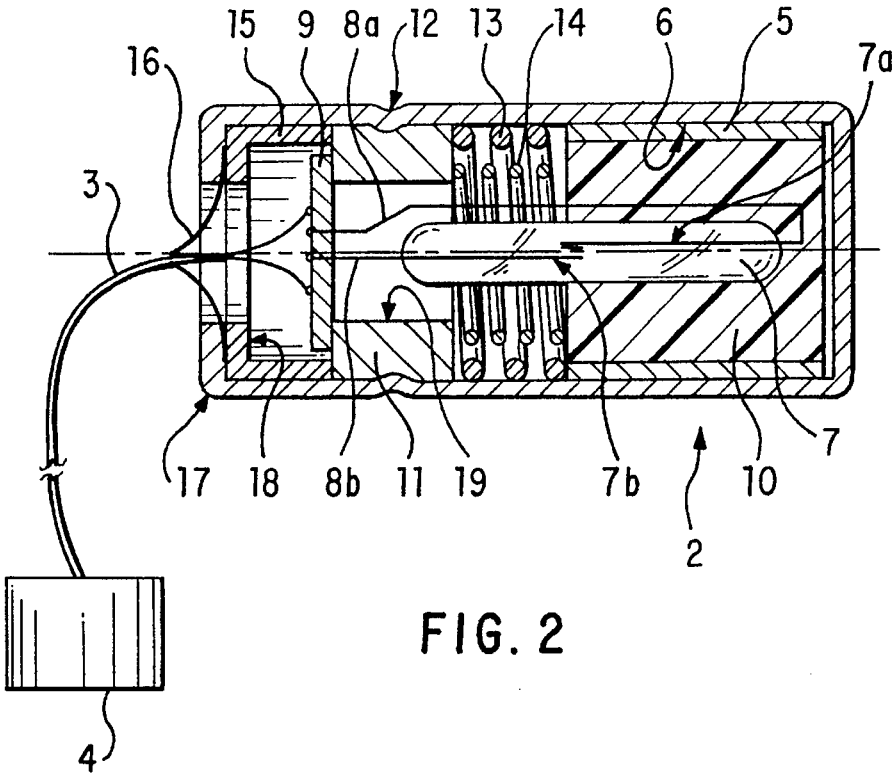
FIG. 2 is an axial section of a detection device according to a first embodiment of the invention.

FIG. 2 is an axial section of a first embodiment of a detection device according to the invention.

The detection device comprises a trigger wire 3 which here consists of a pair of conductors connected to the processing electronics 4.

The trigger wire 3 penetrates inside the weight 2, which consists of a substantially cylindrical casing made, for example, of stainless steel.

A bushing 5 is slidably inserted in the internal cavity 6 of the casing forming the weight 2.

This bushing 5 carries a contactor 7 having at least two magnetic reeds 7*a*, 7*b* arranged inside a glass bulb. The output terminals 8*a* and 8*b* of the contactor 7 are mounted on a printed circuit 9 and they are connected to the conductors of the trigger wire 3.

The contactor 7 and the bushing 5 are attached to one another by a mass 10 of a polymerisable resin of the epoxy or polyurethane type (for example the RE7710 resin made by Hexcel).

The magnetic reed contactors 7*a* and 7*b* are easily obtainable on the market. They are used, for example, in domestic appliances. They comprise magnetic reeds which open or close a contact when the contactor is brought close to a permanent magnet. These contactors are usually known as "reed switches". It is possible, for example, to use the contactors marketed by the German firm Günther.

A permanent magnet 11 of annular shape with a central cavity 19 is attached to the body of the weight 2 by annular crimping 12.

A compression spring 13 is positioned between the magnet 11 and the bushing 5, and holds the bushing 5 at a distance from the magnet 11. The printed circuit 9 then bears upon the magnet 11 and acts as a stop for a moving assembly comprising of the bushing 5 carrying the contactor 7 and the printed circuit 9. A second spring 14 is also placed between the magnet 11 and the bush 5, this spring being made of a shape recall material. The second spring acts as a damper for vibrations of the moving assembly with respect to the body of the weight 2 carrying the magnet 11.

It is known that shape recall materials have useful damping properties. It is therefore possible for a spring made of such a material to act as a damper of mechanical vibrations.

It is possible, for example, to select a shape recall material of the titanium/nickel or copper/zinc/aluminum type.

These materials are obtainable, for example, from the Raychem or Imago companies.

A spacer 15 bears upon the magnet 11, and provides a support surface for a cap 16 made of rubber, which provides a seal at the penetration of the trigger wire 3.

A flange 17 on the body of the weight 2 presses the seal cover 16 against the spacer 15.

The spacer 15 also has a flanged edge 18 which constitutes an axial stop for the printed circuit 9.

The device is assembled in the following manner:

first the contactor 7 is attached to the bushing 5 by means of the filler 10. For this purpose, a tool is used to grip these two components while the filler material is poured;

the bushing 5 carrying the contactor 7, is placed in the cavity 6 of the weight 2; the springs 13 and 14 are inserted;

the magnet 11 is placed in its correct axial position and then attached to the body of the weight 2 by crimping;

the printed circuit 9 is soldered to the contactor terminals 7*a* and 7*b;* the trigger wire 9 is soldered to the printed circuit 9;

the spacer 15 is fitted together with the seal cover 16; and the body of the weight 2 is shaped to give the flanged edge 17.

The device operates as follows:

In the resting position shown on FIG. 2, the contactor 7 is in the axial position most distant from the magnet 11.

The contactor is kept away from the magnet by the spring 13. Since the weight 2 has a certain inertia (or remains in contact with the ground owing to friction between it and the ground), a pull on the trigger wire 3 causes a longitudinal movement of the mobile assembly (comprising of the bushing 5 carrying the contactor 7 and the printed circuit 9) with respect to the body of the weight 2 and the magnet 11.

The axial displacement of the contactor 7 with respect to the magnet 11 causes the contacts 7*a* and 7*b* to close (it is also possible to use normally closed contactors for which the axial displacement will cause the contacts to open).

By causing the contactor 7 to change state, the magnet thus constitutes a means of detecting displacement of the said contactor 7.

The relative axial position of the magnet 11 and contactor 7 will be chosen according to the sensitivity characteristics desired for the device. If the magnet 11 is placed relatively close to the contactor 7, a small displacement will change the state of the said contactor 7.

The change in the contactor's state is used by the processing electronics 4 to cause detonation of the mine. It will be noted that when the trigger wire 3 is released, the contactor 7 is pushed by the spring 13 and once again takes up the resting position shown in FIG. 2. This return movement causes a further change in state of the contactor. It is possible for the electronics 4 to process the information consisting of a series of openings and closures of the contactor 7.

For example, this information may be compared with certain criteria stored in a memory of the electronics 4. The electronics would permit detonation of the mine only when the detected displacement of the trigger wire 3 corresponds to certain desired criteria (for example the number and frequency of openings and closures of the contactor 7).

Thus, it can be seen that the invention permits a precise analysis of the stresses acting on the trigger wire 3 which means that detonation of the mine no longer depends only on the tension generated in the trigger wire 3 as the mine is laid.

The device according to the invention is thus particularly well suited to scatterable mines. Moreover, the means of damping makes it possible to avoid vibrations of the mobile assembly, which adds to the precision of the signal formed by the series of contact openings and closures.

The professional will be able to adjust the sensitivity of the device according to the invention by modifying the stiffness of the spring or springs, the damping provided by the shape recall spring, the amount of allowable contactor travel and the axial position of the magnet.

Figure 3:
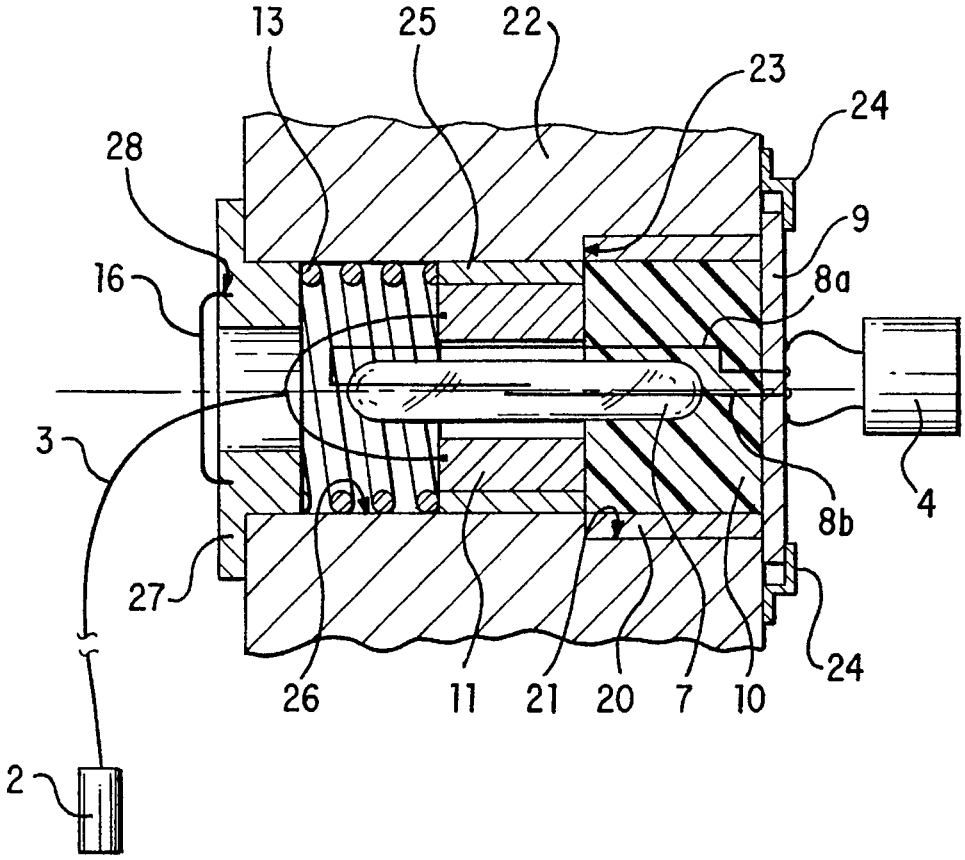
FIG. 3 is an axial section of a detection device according to a second embodiment of the invention.

FIG. 3 illustrates a second embodiment of a detection device according to the invention.

In this embodiment, the contactor 7 is attached to a tube 20 by a mass 10 of resin.

The tube 20 is placed in a cavity 21 made in a support 22 attached to the body of the mine itself.

The tube 20 is pressed against a shoulder 23 and is prevented from moving axially by the printed circuit 9, which is itself attached to the support 22 by flanges 24. The terminals 8*a* and 8*b* of the contactor 7 are connected to the processing electronics 4 through the connecting printed circuit 9. The magnet 11 is attached to a tube 25 (for example by glueing).

This tube 25 is slidably mounted in a cavity 26 made in the support 22. Such an arrangement means that the tube 25 can be made of a material that lends itself to sliding. The trigger wire 3 is attached to the magnet 11 by any appropriate means (by screwing, soldering or crimping).

The magnet 11 attached to the tube 25 thus comprises a mobile assembly capable of moving longitudinally with respect to the support 22 when the trigger wire 3 is displaced. The contactor 7 comprises means of detecting the displacement of the magnet 11. The contactor 7 shown here is kept in the closed state by the magnet 11. Any displacement of the magnet 11 causes the contactor 7 to open.

It is clearly possible to use contactors which will be open when the magnet 11 is in the position shown in FIG. 3 and which will close when the magnet 11 is displaced. A compression spring 13 is placed between the magnet 11 and a cover 27. The cover 27 is itself fixed by screws to the support 22. The spring 13 holds the magnet 11 against the resin mass 10. Means of damping (not shown here), for example a spring made of a shape recall material, could be interposed between the magnet 11 and the cover 27.

A rubber cap 16 provides a seal, through which the trigger wire 3 passes. It is fitted in a groove 28 made in the cover 27.

The advantage of this method of construction is that it allows a non-conducting trigger wire to be used (which is therefore cheaper). For example, a nylon line could be used. The weight 2 which is ejected from the mine can then be solid.

Operation is similar to that of the device according to the embodiment shown in FIG. 2. However, the mobile assembly of the second embodiment comprises the magnet 11, and the contactor 7 remains fixed.

Any displacement of the trigger wire 3 will cause the magnet 11 to move longitudinally, thus changing the state of the contactor 7. Since the inertia of the mine is greater than that of the weight 2, this method of construction makes it possible to design a highly sensitive detection device.

The processing electronics 4 will also be able to process a signal comprising a series of openings and closures of the contactor 7.

Figure 4:
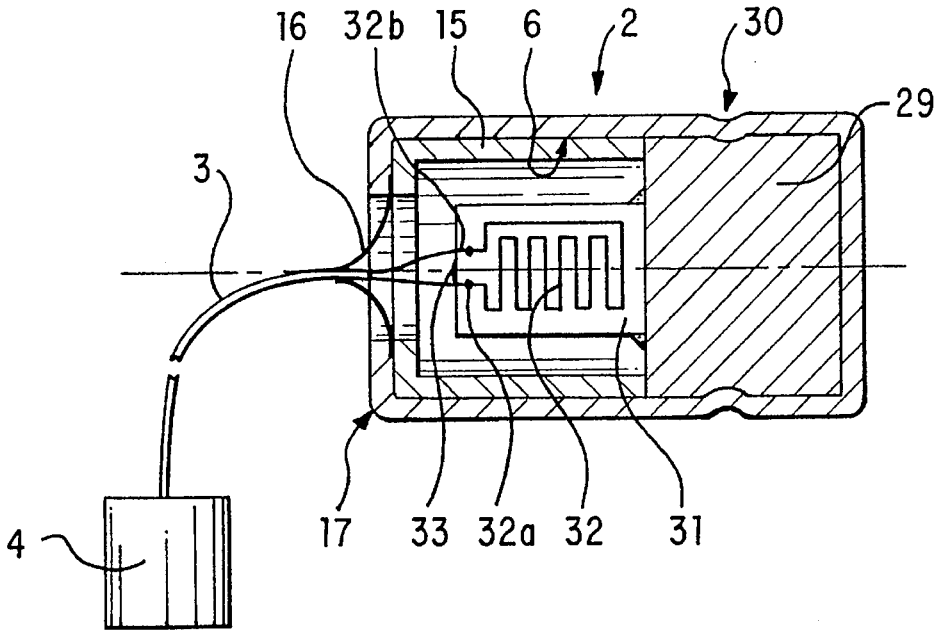
FIG. 4 is an axial section of a detection device according to a third embodiment of the invention.

FIG. 4 illustrates a third embodiment of a detection device according to the invention.

This embodiment comprises a weight 2 with a cavity 6, inside of which is placed a cylinder 29 attached to the weight 2 by annular crimping 30. A small plate 31 of rectangular shape and low thickness (of the order of one millimeter) is attached to the cylinder 29 by glueing. The plate can be made of a material having a relatively high coefficient of linear expansion (for example a plastics material of the polyamide type).

It will be possible to adopt another type of material, in which case the characteristics of the gauge used and of the associated processing electronics will be adapted to the order of magnitude of the forces to be measured.

The plate 31 is a fixed component to which the trigger wire 3 is attached.

The plate has a strain gauge 32 glued on one rectangular surface. The trigger wire 3 comprises two conductors connected to the processing electronics 4. The conductors are also connected to the terminals 32*a* and 32*b* of the strain gauge 32. In order to improve the mechanical integrity of the device, the trigger wire is also connected to the plate 31 by means of glue 33.

A spacer 15 bears against the cylinder 29, providing a supporting surface for a rubber cap 16 which provides a seal at the penetration of the trigger wire 3. A flanged edge 17 on the body of the weight 2 presses the seal 16 on the spacer 15.

The operation of the device is as follows:

A pull on the trigger wire 3 causes a deformation of the plate 31, which modifies the resistance of the strain gauge 32. This change is analysed by the processing electronics 4. The advantage of this method of construction is that it is possible to analyse the plate deformation signal in a precise and continuous manner, and therefore to detonate the mine only in well defined conditions of displacement of trigger wires, even with a particular combination of signals provided by different trigger wires.

The professional will be able to adjust the sensitivity of the device by a suitable choice of the deformation characteristics of the plate (as regards material and shape) and the sensitivity of the gauge.

In this way it is possible to modify the geometry of the plate to adapt the sensitivity of the detection device. For example it is possible to define a U-shaped plate with one vertical branch attached to the cylinder 29 and the other branch carrying the trigger wire at its end.

The strain gauge will then be mounted at the bottom of the U. A pull on the trigger wire will have the result of opening the U, the separation of the two branches of the U causing a deformation at its base.

Figure 5:
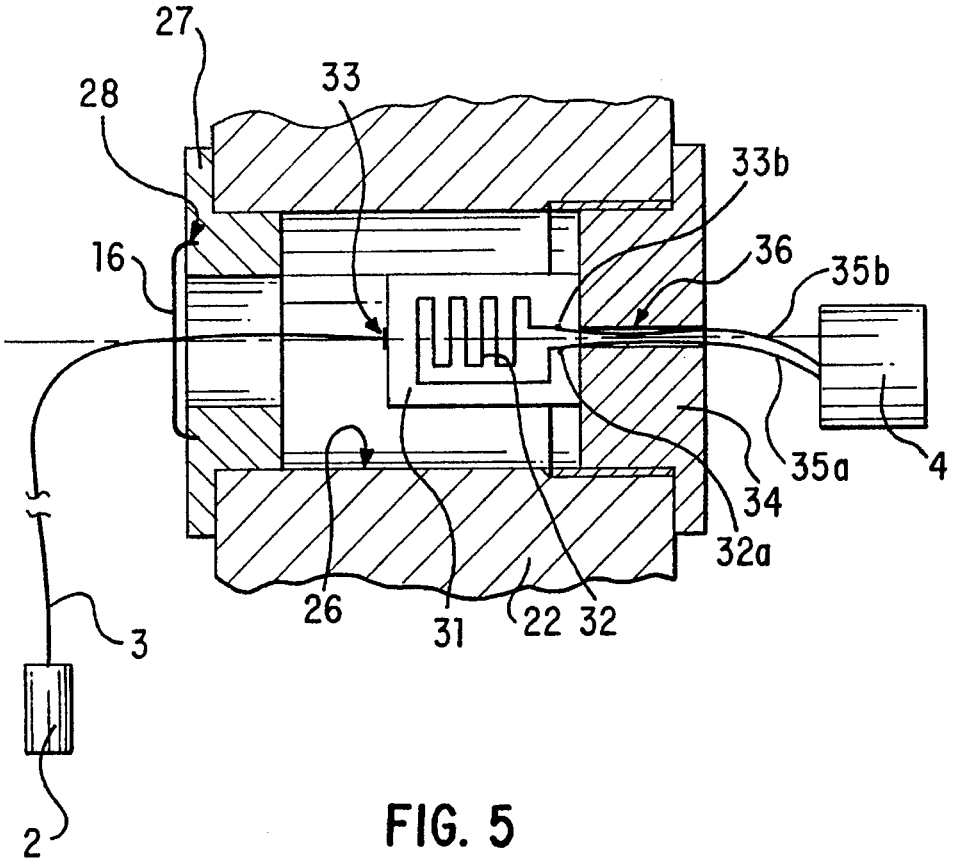
FIG. 5 is an axial section of a detection device according to a fourth embodiment of the invention.

With a plate of such a shape, it is possible to obtain deformations that are easy to detect and measure by the gauge, even when the force applied is small. FIG. 5 illustrates a fourth embodiment of a detection device according to the invention.

In this embodiment, the plate 31 is glued to a plug 34. The plug 34 is threaded into a cavity 26 of the support 22, which is attached to the body of the mine itself.

The terminals 32*a* and 32*b* of the strain gauge 32 are connected to the processing electronics 4 by conductors 35*a* and 35*b* which pass through the plug 34 via a hole 36. The trigger wire 3 is attached to one end of the plate 32 by glue 33.

The advantage of this method of construction is that it makes it possible to use a trigger wire which is non-conducting, and therefore inexpensive.

This method of construction also makes it possible to obtain very high sensitivity owing to the inertia of the mine to which the plate is attached.

Other variants are possible without departing from the principle of the invention. For example it is possible to place on the printed circuit 9 (FIG. 2) electronic components for initial processing of the information provided by the contactor (for example, electronic filtering or shaping of the signal pulses).

It is also possible to combine a strain gauge plate (attached to the mine as in FIG. 5) with a weight comprising a contactor (FIG. 2), in order to broaden the detection capability of the device.

Figure 6A:
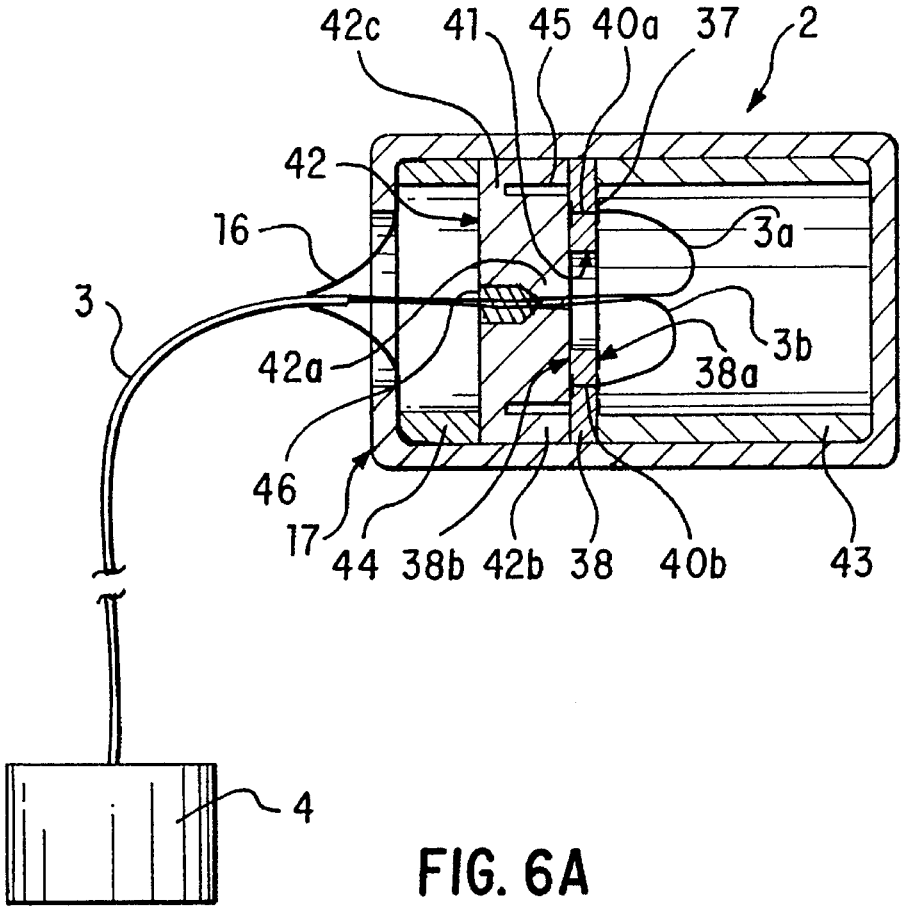
FIG. 6A is an axial section of a detection device according to a fifth embodiment of the invention.

This will be particularly attractive when the device according to the invention is used in conjunction not with a mine, but with a system of surveillance of an area or route. FIG. 6A is an axial section of a detection device according to a fifth embodiment of the invention. Here the trigger wire 3 comprises of a pair of conductors 3*a*, 3*b* connected to the processing electronics 4. The weight 2 is again a substantially cylindrical casing into which the trigger wire 3 penetrates. The ends of the conductors 3*a* and 3*b* are soldered to an electrical circuit 37 mounted on a plate 38 according to the conventional techniques of printed circuits.

The circular plate 38 is made of an insulating material. The electrical circuit 37 has two conducting studs, carried on one surface 38*a* of the plate, and upon which are soldered the ends of the conductors 3*a*, 3*b*.

Figure 6B:
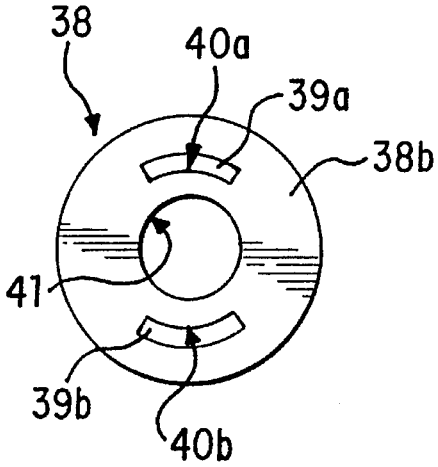
FIG. 6B shows the surface of the plate carrying the electrical circuit with which the membrane is in contact.

These conducting studs are connected by conducting straps 40*a*, 40*b* to two conducting tracks 39*a*, 39*b* carried on the other surface 38*b* of the plate 38 (see also FIG. 6B). The plate 38 has a central circular opening 41 designed to allow the trigger wire 3 to pass through. A membrane 42 is mounted on the surface 38*b* of the plate 38. This membrane is made of a flexible synthetic material such as fluoro silicone.

In its central part 42*a* a hole 46 is made, through which the trigger wire 3 is passed. It also has a peripheral part 42*b* which is fitted to the inside diameter of the weight 2. The membrane 42 and the plate 38 are fitted into the weight by means of spacers 43 and 44. The spacer 43 serves to position the plate 38 with respect to the end of the weight 2. The membrane 42 is in contact with the plate 38, and its peripheral part 42*b* is held stationary with respect to the weight 2 by means of the second spacer 44. A flanged edge 17 on the body of the weight 2 immobilizes the spacers 43 and 44, the plate 38 and the peripheral part 42*b* of the membrane in an axial direction with respect to the weight.

The flanged edge 17 also retains a seal cover 16 by pressing it against the spacer 44. The spacers also serve to compress the peripheral part 42*b* of the membrane, which presses the said membrane against the inside surface of the weight and improves the seal. As a variant, it would be possible to omit the seal 16, the seal then being provided by the membrane 42 alone. The central and peripheral parts 42*a* and 42*b* respectively of the membrane are separated by a zone of reduced thickness 42*c* which favors deformation of the membrane. The zone of reduced thickness here consists of an annular grove 45 made on one surface of the membrane 42. The width and depth of the groove 45 are selected by the professional so as to confer on the membrane 42 the desired flexibility for the type of material considered. The hole 46 through which the trigger wire passes is blanked off by filling with a material such as adhesive, which not only provides a seal but also attaches the trigger wire 3 mechanically to the central part 42*b* of the membrane. The membrane 42 has a conducting surface which is in contact with the tracks 39*a* and 39*b* of the electrical circuit 37 and which connects these two tracks together electrically. In this way the membrane 42 closes the circuit 37 by providing an electrical connection between the conductors 3*a* and 3*b*.

The membrane 42 will preferably be made of a conducting material, for example a synthetic material doped with metal or carbon.

As a variant, it is also possible to produce a membrane 42 with a metal coating on its surface that makes contact with the tracks 39*a* and 39*b*.

The device is assembled in the following manner:

—the trigger wire 3 is passed through the hole 46 in the membrane 42, and then the trigger wire 3 is glued to the membrane 42;

the trigger wire 3 is passed through the opening 41 in the plate 38 and the conductors 3*a* and 3*b* are soldered to the circuit 37. During this operation, a sufficient length of trigger wire is left so that when the trigger wire 3 is pulled, the membrane 42 can deform without damaging the soldering of the conductors 3*a* and 3*b* on the plate 38;

the spacer 43, the plate 38, the membrane 42, the spacer 44 and the seal 16 are fitted in the weight 2;

the body of the weight 2 is formed to give the flanged edge 17.

The operation of this device is as follows:

Since the weight 2 has a certain inertia (or remains stationary on the ground owing to friction therewith), a pull on the trigger wire 3 causes an axial movement of the central part 42*a* of the membrane 42 with respect to the peripheral part 42*b* (and hence with respect to the weight 2).

This axial movement is made possible by the presence of the zone of reduced thickness 42*c*. Because of the special structure of the membrane 42, its deformation is localized at the zone of reduced thickness 42*c*. The result is a sudden break in the electrical contact between the membrane 42 and the tracks 39*a*, 39*b* of the electrical circuit. The force needed to open the contact is moderate and depends upon the dimensions of the zone of reduced thickness 42*c*.

The elasticity of the membrane material causes its central part 42*a* to return to make a contact with the tracks 39*a*, 39*b* when the trigger wire 3 is released.

The change in state of the contactor is utilized by the processing electronics 4 to detonate the mine.

It is still possible here for the electronics 4 to process the information comprising a series of openings and closures of the contactor.

This embodiment of the invention is particularly robust and inexpensive.

As a variant, it would be possible to shape the zone of reduced thickness 42*c* (by moulding) in such a way that the central part of the membrane 42*a* does not return after separation from the tracks 39*a*, 39*b*.

Figure 7:
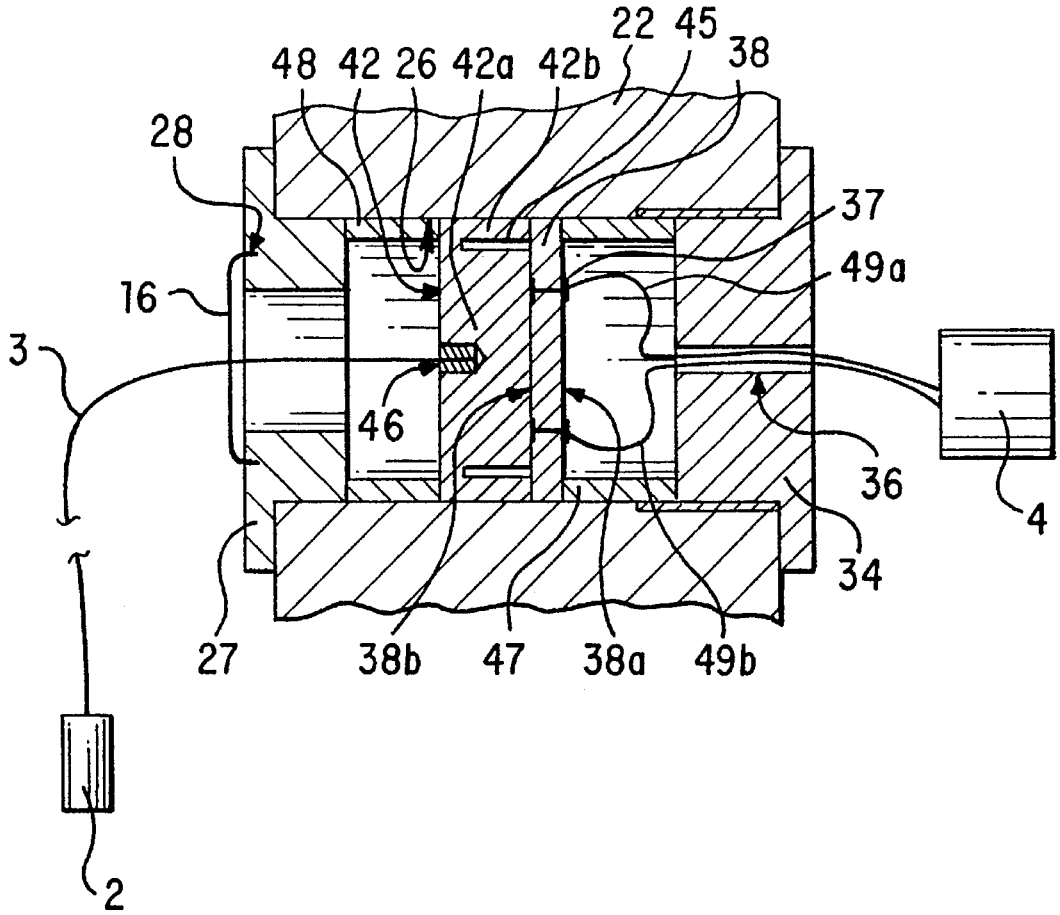
FIG. 7 is an axial section of a detection device according to a sixth embodiment of the invention.

FIG. 7 is an axial section of another embodiment of the invention in which the membrane 42 and the plate 38 are located in a cavity 26 made in a support 22 attached to the body of the mine itself. The cavity is closed at one end by the cover 27 and at the other by the threaded plug 34. Spacers 47, 48 position the membrane and the plate axially in the cavity 26. They also fix the plate 38 and the peripheral part 42*b* of the membrane with respect to the support 22. A rubber cap 16 provides a seal where the trigger wire 3 penetrates. It is fitted in a groove 28 made in the cap 27. As before, it would be possible to omit the cap 16 and for the seal to be provided by the membrane 42 itself, whose peripheral part 42*b* is pressed against the inside surface of the cavity 26 due to compression by the spacers 47 and 48. The electrical circuit 37 carried by the plate 38 is connected to the processing electronics 4 by conductors 49*a* and 49*b* which pass through a hole 36 in the plug 34.

The trigger wire 3 is attached to the central part 42*a* of the membrane 42 in a hole 46 filled with adhesive.

The advantage of this method of construction is that it enables the use of a non-conducting, and hence inexpensive, trigger wire 3.

The weight 2 which is ejected from the mine can then be solid. Since the inertia of the mine is higher than that of the weight, this method of construction makes it possible to design a highly sensitive detection device. Operation is similar to that of the device according to the embodiment shown on FIG. 6.

I claim:

1. A device for detecting a target and for triggering the detonation of a mine, comprising:

a detonator that detonates the mine in response to a detection signal;

a trigger wire that is displaceable by the target;

a signal member attached to the trigger wire and comprising a deformable plate, said signal member being located on a support, the support being attached to the mine or locatable apart from the mine; and a detector that generates the detection signal due to deformation of the deformable plate.

2. The device of claim 1 wherein the detector comprises a strain gauge mounted on the plate.

3. The device of claim 1, wherein the support is attached to the mine.

4. The device of claim 1, wherein the support comprises a support member locatable apart from the mine.

5. The device of claim 1, wherein the deformable plate has a deformable portion that is deformable between a first position and a second position, and wherein the detector comprises an electrical circuit that is closed when the deformable portion is in one of the first and second positions and that is open when the deformable portion is in the other of the first and second positions.

6. The device of claim 5, wherein the deformable plate has a first portion, a second portion, and an intermediate portion between the first and second portions, the intermediate portion having a thickness smaller than a thickness of the first and second portions.

7. The device of claim 5, wherein a surface of the deformable plate is formed of an electrically conductive material that closes the electrical circuit when the deformable portion is in one of the first and second positions.

8. The device of claim 5, wherein the support comprises a support member locatable apart from the mine, and wherein the trigger wire comprises a pair of electrical conductors that are attached to the electrical circuit.

9. The device of claim 8, wherein the trigger wire is attached to the deformable member by an adhesive.

10. The device according to claim 1, wherein tension in said trigger wire causes said signal member to be displaced or deformed.

11. The device according to claim 11, wherein the trigger wire is nonconductive.

12. The device according to claim 4, wherein the support member supports said signal member while said support member is located away from said mine.

* * * * *